US011313584B2

(12) United States Patent
Deivasigamani et al.

(10) Patent No.: US 11,313,584 B2
(45) Date of Patent: Apr. 26, 2022

(54) ZERO PRESSURE DROP WATER HEATING SYSTEM

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 551 days.

(21) Appl. No.: 16/383,853

(22) Filed: Apr. 15, 2019

(65) Prior Publication Data

US 2019/0242618 A1 Aug. 8, 2019

Related U.S. Application Data

(63) Continuation-in-part of application No. 15/161,216, filed on May 21, 2016, now Pat. No. 10,260,774.

(60) Provisional application No. 62/164,668, filed on May 21, 2015.

(51) Int. Cl.

| | |
|---|---|
| ***F24H 1/10*** | (2022.01) |
| ***F24H 9/20*** | (2022.01) |
| ***F24H 1/08*** | (2022.01) |

(52) U.S. Cl.

CPC ..... *F24H 1/10* (2013.01); *F24H 1/08* (2013.01); *F24H 9/2007* (2013.01)

(58) Field of Classification Search

CPC .. F24D 17/0026; F24D 3/1066; F24D 3/1091; F24D 2200/053

USPC ..... 122/235.29

See application file for complete search history.

(56) References Cited

U.S. PATENT DOCUMENTS

| | | | | |
|---|---|---|---|---|
| 6,347,748 | B1 * | 2/2002 | Lyons | F24D 3/12 237/69 |
| 2007/0144458 | A1 * | 6/2007 | Mukomilow | F24D 3/1066 122/493 |
| 2012/0138149 | A1 * | 6/2012 | Hatada | G05B 15/02 137/1 |
| 2015/0122902 | A1 * | 5/2015 | Sorensen | F24D 3/1091 237/80 |

* cited by examiner

*Primary Examiner* — Steven B McAllister
*Assistant Examiner* — John E Bargero
(74) *Attorney, Agent, or Firm* — Tracy Jong Law Firm; Tracy P. Jong; Cheng Ning Jong

(57) ABSTRACT

A zero pressure drop water heating system comprising a cold side conductor having a receiving end and a closed end; a hot side conductor having an exit end and a closed end; a pump; a bypass conductor having a first end, a second end and a bypass valve, wherein the first end is adapted to the receiving end and the second end is adapted to the exit end; at least one heat exchanger having a flow valve; a heat exchanger inlet temperature sensor disposed on the inlet of one of the at least one heat exchanger; an outlet temperature sensor disposed at an outlet of the at least one heat exchanger closest to the exit end; a system outlet temperature sensor disposed on the exit end and a system inlet temperature sensor disposed on the receiving end.

10 Claims, 11 Drawing Sheets

| Demand at System Outlet (GPM) | Flowrate at location (GPM) | | | | | |
|---|---|---|---|---|---|---|
| | A | B | C | D | E | F |
| 0 | 0 | 5 | 5 | 5 | 5 | 0 |
| 1 | 1 | 5 | 4 | 5 | 4 | 1 |
| 5 | 5 | 5 | 0 | 5 | 0 | 5 |
| 6 | 6 | 5 | -1 | 5 | -1 | 6 |

ZERO PRESSURE DROP WATER HEATING SYSTEM

PRIORITY CLAIM AND RELATED APPLICATIONS

This continuation-in-part application claims the benefit of priority from non-provisional application U.S. Ser. No. 15/161,216 filed May 21, 2016 which in turn claims the benefit of priority from provisional application U.S. Ser. No. 62/164,668 filed May 21, 2015. Each of said applications is incorporated by reference in its entirety.

BACKGROUND OF THE INVENTION

1. The Field of the Invention

The present invention is directed generally to a tankless water heating system applicable to a wide variety of applications including high rise buildings or any applications where pressure drop is a critical issue. More specifically, the present invention is directed to a water heating system configured to overcome not only pressure drop but also pressure rise associated with tankless water heating systems.

2. Background Art

High rise buildings are traditionally serviced using tank water heating systems or boiler and tank water heating systems instead of tankless water heating systems due to the pressure required to send water to great elevations. Such tank systems are energy inefficient as a large amount of water is prepared ahead of time, prior to the existence of a demand, to anticipate such a demand. While in storage, the thermal energy stored in the heated water is wasted to the tank surroundings even with tank insulation. Previous attempts have been made in the water heating industry to use energy efficient water heating systems to service high rise buildings and other venues requiring increased pump pressure but they have not been successful. Introducing a water heater with a large pressure drop causes the difference in pressure between the hot and cold side to be larger than desired and may cause building water distribution systems to not work properly. However, no previous attempts have been successful in keeping pressure drop low while avoiding the effects of negative pressure while heating water on demand. Further, no previous attempts have been successful in creating a zero pressure drop condition where users of a tankless water heating system does not experience inadvertent pressure drop and/or pressure rise conditions arising from the tankless water heating system.

Thus, there is a need for a zero pressure drop water heating system that does not include a tank water heating system.

SUMMARY OF THE INVENTION

In accordance with the present invention, there is provided a zero pressure drop water heating system including a cold side conductor including a receiving end and a closed end; a hot side conductor including an exit end and a closed end; a pump; a bypass conductor including a first end, a second end and a bypass valve disposed between the first end and the second end of the bypass conductor, wherein the first end of the bypass conductor is adapted to the receiving end of the cold side conductor and the second end of the bypass conductor is adapted to the exit end of the hot side conductor; at least one heat exchanger including a flow valve; an inlet temperature sensor disposed on an inlet of the at least one heat exchanger; an outlet temperature sensor disposed on an outlet of the at least one heat exchanger closest to the exit end of the hot side conductor; a system outlet temperature sensor disposed on the exit end of the hot side conductor; and a system inlet temperature sensor disposed on the receiving end of the cold side conductor, wherein the receiving end of the cold side conductor is configured to be connected to a cold water supply manifold, the exit end of the hot side conductor is configured to be connected to a hot water supply manifold, the pump is configured to generate a flow through each of the at least one heat exchanger and whereby when a temperature indicated by the inlet temperature sensor exceeds a temperature indicated by the system inlet temperature sensor, the flow valve of the at least one heat exchanger is configured to be restricted to enable an increased flow from the receiving end of the cold side conductor to the exit end of the hot side conductor through the bypass conductor to temper a flow exiting the exit end of the hot side conductor, when a temperature indicated by the system outlet temperature sensor falls below a temperature indicated by the inlet temperature sensor, the flow valve of the at least one heat exchanger is configured to be enlarged to enable an increased flow from the cold side conductor to the exit end of the hot side conductor through the at least one heat exchanger to increase the temperature of the flow exiting the exit end of the hot side conductor and at least one of the bypass valve, the flow valve and the pump is used for controlling flow through the zero pressure drop water heating system to result in a pressure drop of zero at the exit end of the hot side conductor.

In one embodiment, the bypass conductor further includes an exhaust disposed on the second end of the bypass conductor, the exhaust including at least one opening configured for allowing effluents of the at least one opening to be pointed in a direction from the exit end of the hot side conductor to the closed end of the hot side conductor.

In one embodiment, the bypass conductor further includes an exhaust disposed on the second end of the bypass conductor and the hot side conductor further includes an upper half and a lower half and the exhaust is configured to be disposed on the upper half of the hot side conductor.

In one embodiment, the bypass conductor further includes an exhaust disposed on the second end of the bypass conductor and the hot side conductor further includes an upper half and a lower half and the exhaust is an inverted J-shaped exhaust including at least one opening disposed on the upper half of the hot side conductor.

In one embodiment, the bypass conductor further includes an exhaust disposed on the second end of the bypass conductor, the exhaust further includes at least one opening configured for allowing effluents of the at least one opening to be pointed in a direction perpendicular to a direction from the exit end of the hot side conductor to the closed end of the hot side conductor.

In one embodiment, the hot side conductor further includes a volume of from about 0.5 to about 2 gallons and the bypass conductor includes a tubing of size of from about 0.5 to about 1.5 inches.

In one embodiment, the bypass valve is an on-off valve. In another embodiment, the bypass valve is a modulating valve.

An object of the present invention is to provide an on-demand water heating system capable of servicing customers at significant elevations without significant ill effects due to pressure drop and positive pressure.

Another object of the present invention is to provide an on-demand water heating system to buildings traditionally serviced only using tank water heating systems due to the inability of previously available tankless water heating systems in countering the ill effects of positive pressure.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—low pressure drop tankless water heating system
4—cold side conductor
6—hot side conductor
8—heat exchanger
10—bypass conductor
12—pump
14—exhaust, e.g., J-shaped exhaust
16—aperture
18—exit nozzle of heat exchanger
20—receiving end of cold side conductor
22—exit end of hot side conductor
24—cold water supply manifold
26—hot water supply manifold
28—heat exchanger inlet temperature sensor
30—heat exchanger outlet temperature sensor
32—flow valve
34—high rise building
36—cold water supply into building
38—system inlet temperature sensor
40—system outlet temperature sensor
42—point of use
44—line dividing upper half and lower half of hot side conductor
46—pressure booster pump
48—external recirculation pump
50—check valve
52—external recirculation line
54—pressure regulating valve
56—valve
58—valve
60—flow Particular Advantages of the Invention In comparison with tank water heating systems, the present water heating system is significantly more energy efficient as the present water heating system takes advantage of a tankless heating system which only prepares hot water when a demand exists or a short period before a demand exists.

In comparison with previously available tankless water heating systems, the present water heating system is capable of low pressure drop while avoiding positive pressure considered undesirable by users especially at high flowrates.

A zero pressure drop condition can be experienced by an end user with the present water heating system. The present water heating system provides a net pressure drop of zero at the system outlet while the desired temperature at the system outlet is maintained. In conventional centralized or clusterized hot water systems, e.g., those used in high rise systems, the plumbing systems involved can be complex utilizing variable frequency drive pumps and relief valves setup to provide adequate recirculation and pressure and any deviation in pressure causes inadequate hot water delivery. The present zero pressure drop water heating systems provide drop-in replacements of such conventional systems while maintaining thermal efficiencies and meeting the requirements of hot water deliveries.

Detailed Description of a Preferred Embodiment

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
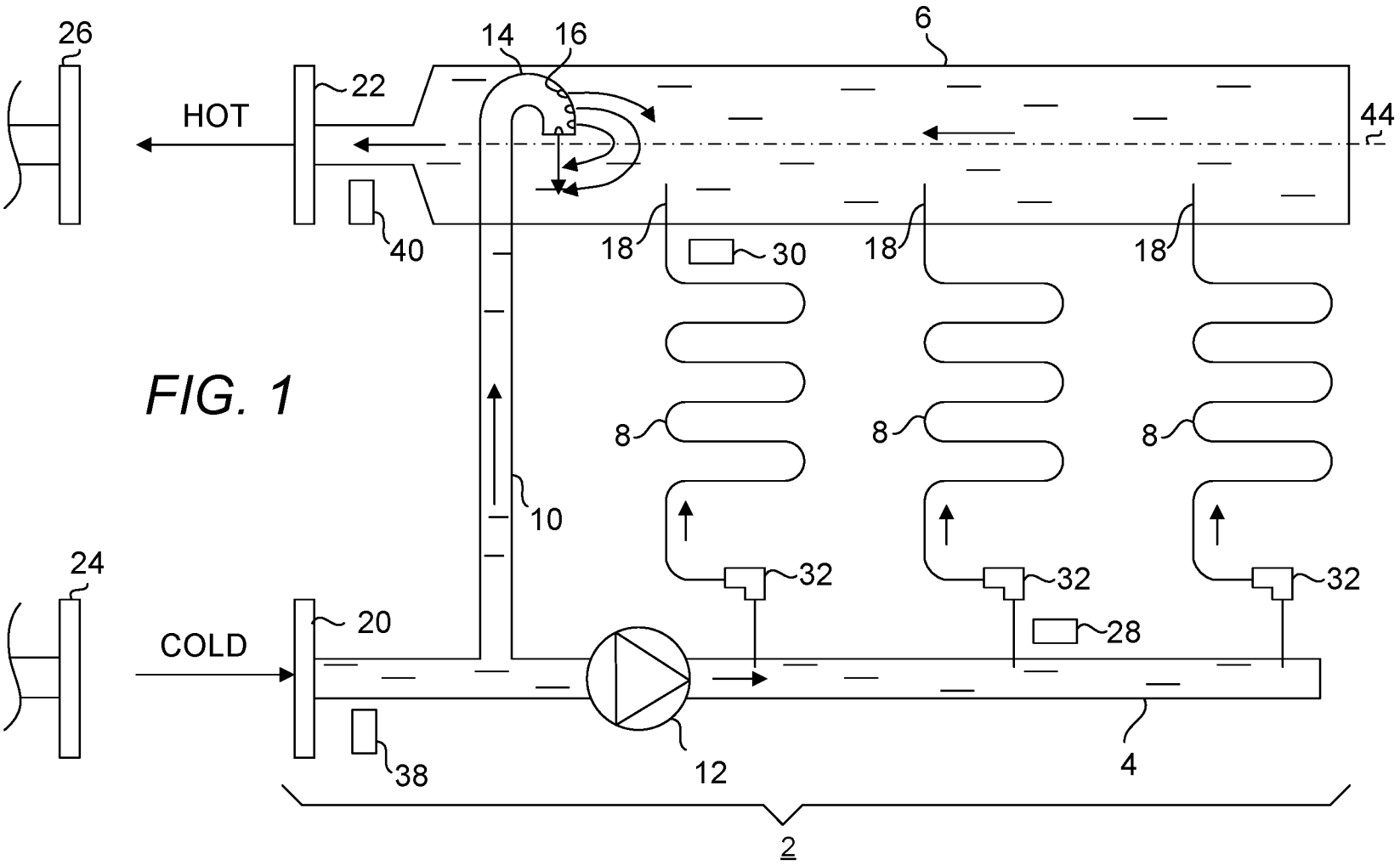
FIG. 1 is a diagram depicting one embodiment of a low pressure drop water heating system where one or more heat exchangers are used and a forward flow is observed in the bypass conductor.
Figure 2:
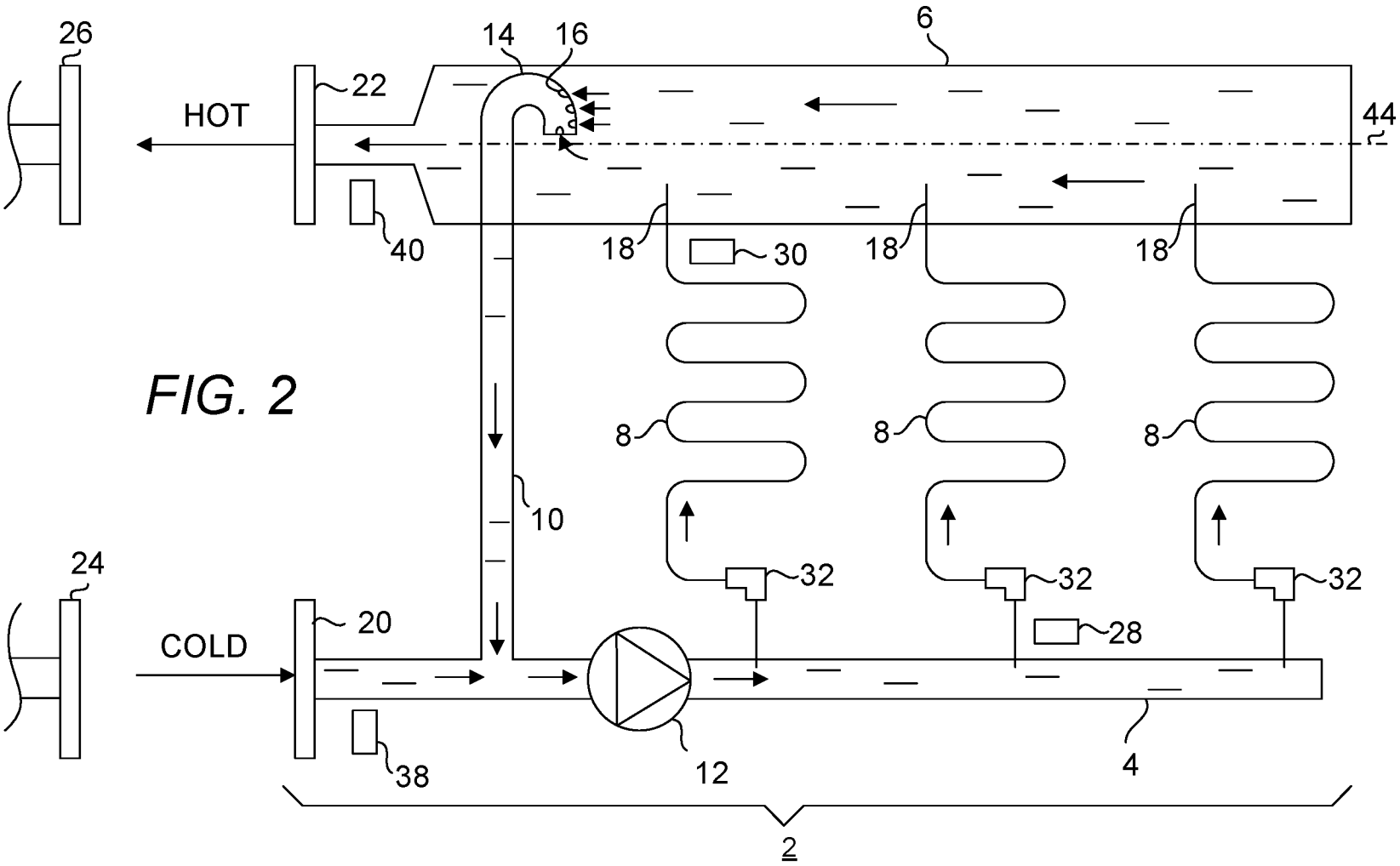
FIG. 2 is a diagram depicting one embodiment of a low pressure drop water heating system where one or more heat exchangers are used and a recirculation or reverse flow is observed in the bypass conductor.

FIG. 1 is a diagram depicting one embodiment of a low pressure drop water heating system 2 where one or more heat exchangers 8 are used and a forward flow is observed in the bypass conductor 10. FIG. 2 is a diagram depicting one embodiment of a low pressure drop water heating system 2 where one or more heat exchangers 8 are used and a recirculation or reverse flow is observed in the bypass conductor 10. Disclosed herein is a low pressure drop water heating system 2 including a cold side conductor 4, a hot side conductor 6, a pump 12, a bypass conductor 10, at least one heat exchanger 8, a heat exchanger inlet temperature sensor 28 disposed on the inlet of one of the three heat exchangers 8, a heat exchanger outlet temperature sensor 30 disposed at an outlet or exit nozzle 18 of one of the three heat exchangers 8, a system outlet temperature sensor 40 disposed on the exit end of the hot side conductor 6 and a system inlet temperature sensor 38 disposed on the receiving end of the cold side conductor 4. Alternatively, each heat exchanger may have its own inlet temperature sensor. However, in this embodiment, only one inlet temperature sensor is used as each heat exchanger experiences a flow originating from a common source. Alternatively, each heat exchanger may also have its own outlet temperature sensor. However, in this embodiment, only one outlet temperature sensor is used as the output flow from each heat exchanger is required to flow past an outlet temperature sensor disposed at the exit nozzle of heat exchanger 8 that is disposed closest to the exit end of hot side conductor 22. The cold side conductor 4 includes a receiving end and a closed end. The hot side conductor 6 includes an exit end and a closed end. In one embodiment, the hot side conductor 6 is configured to hold a volume of water of from about 0.5 to about 2 gallons. In one embodiment, the fluid conductor of a heat exchanger 8 is a tubing having a size of about ¾ inch. The bypass conductor 10 includes a first end and a second end, wherein the first end of the bypass conductor 10 is fluidly adapted to the receiving end of the cold side conductor 4 and the second end of the bypass conductor is fluidly adapted to the exit end of the hot side conductor 6. In one embodiment, the bypass conductor (10) is a tubing having a size of from about 0.5 to about 1.5 inches. Each heat exchanger 8 includes a flow valve 32. The pump 12 increases pressure of water delivered to points of use 42 and negates the pressure drop across heat exchangers 8. Although, with the positive pressure generated by the pump 12, delivery of water is considered satisfactory for some, for others, the increased pressure may come as a surprise, e.g., when used in a sink or shower. The receiving end 22 of the cold side conductor 4 is configured to be connected to a cold water supply manifold 24 or a port where unheated incoming water is supplied. The exit end 20 of the hot side conductor 6 is configured to be connected to a hot water supply manifold 26 or a port where now heated or hot water is sent out of the water heater and eventually to points of use. The pump 12 is configured to generate a flow through each of the heat exchangers 8. Shown in each of FIGS. 1 and 2 are three heat exchangers 8 although any suitable number of heat exchangers may be used to collectively meet the demand requested through the hot water supply manifold 26 by hot water users.

There are two ways to fundamentally curve shape a pressure drop profile (e.g., Pressure Loss vs. Flow plots). In both case, the system outlet temperature sensor 40 is utilized. A first method involves using a single-speed, less costly, constant speed pump that can create a very large pressure rise at lower flows in place of pump 12. During these lower flows, the flow into one or more of the three heat exchangers 8 is restricted via a flow valve 32. The net result is called "curve shaping" of the pressure drop to mimic the typical pressure drop curve of a tank water heater. A second method involves using a variable speed pump in place of pump 12 to continuously increase speed/pressure from a low to a higher flow, thus again "curve shaping" the pressure drop to mimic pressure drop curve of a tank water heater. In both cases, if a demand is greater than the flowrate the pump 12 can provide to the heat exchangers 8, the required flow is met by increasing the flow via the bypass line, again effecting a low pressure loss.

During a large flow demand jump as typified by the flow configuration shown in FIG. 1, a portion of the cold inlet flow bypasses the heat exchangers 8 and instead flows through the bypass conductor 10 from the cold side conductor 4 to the hot side conductor 6. With the bypass conductor 10, the present water heating system is capable of reducing pressure drop through the heat exchangers 8 by channeling sufficient flow directly through a larger fluid bypass conductor 10 without pressure drop causing equipment, e.g., the rather small fluid conductors of the heat exchangers 8 and flow valves 32, etc., from the cold side conductor 4 to the hot side conductor 6, incurring a significantly lower pressure drop. As the bypass or forward flow is unheated, it is required to be mixed with the heated flow from the heat exchangers 8. When bypass flow occurs from the cold side conductor 4 to the hot side conductor 6, the setpoint temperature of the heat exchangers 8 must be set to a higher value than the desired resultant temperature of the mixed water. For instance, in order to achieve a final delivery temperature of 120 degrees F., the setpoint temperature of the heat exchangers may be set at 140 degrees F. Upon mixing, the water temperature at the exit end 22 of the hot side conductor 6 may approximate 120 degrees F.

When the temperature indicated by the heat exchanger inlet temperature sensor 28 exceeds the temperature indicated by the system inlet temperature sensor 38, the flow valve 32 of at least one of the heat exchangers 8 is configured to be restricted to enable an increased flow from the receiving end of the cold side conductor 4 to the exit end of the hot side conductor 6 through the bypass conductor 10 to temper the water exiting the exit end of the hot side conductor 6. When the temperature indicated by the system outlet temperature sensor 40 falls below the temperature indicated by the heat exchanger inlet temperature sensor 28, the flow valve 32 of at least one of the heat exchangers 8 is configured to be enlarged to enable an increased flow from the cold side conductor 4 to the exit end 22 of the hot side conductor 6 through the heat exchangers 8 to increase the temperature of the water mixture exiting the exit end 22 of the hot side conductor 6, i.e., a higher flowrate of hot water will be produced through the heat exchangers 8 while the cold water flowrate through the bypass conductor 10 is reduced.

If the water temperature indicated by the heat exchanger inlet temperature sensor 28 is higher than temperature as indicated by the system inlet temperature sensor 38, then a recirculation or reverse flow is said to be occurring as the water arriving at the heat exchangers 8 is now disposed at a temperature that is different than the cold water just entering the heating system 2. Referring to FIG. 2, this event occurs when hot water demand decreases to a point where the flow that is caused by the pump 12 through the heat exchangers 8 is now flowing in the direction contrary to the bypass flow. One or more of the flow valves 32 may then be restricted such that the water temperature indicated by the heat exchanger inlet temperature sensor 28 drops to the temperature indicated by the system inlet temperature sensor 38. If the water temperature indicated by the system outlet temperature sensor 40 is below the temperature indicated by the outlet temperature sensor 30, one or more of the flow valves 32 are opened such that less or no cold water will bypass from the cold side conductor 4 to the hot side conductor 6 but a reverse flow will occur in the bypass conductor 10, causing the system outlet temperature sensor 40 to experience a higher temperature. In one embodiment, the second end of the bypass conductor 10 includes an exhaust 14 having openings 16 which allow effluents from the openings to be pointed in a direction from the exit end 22 of the hot side conductor 6 to the closed end of the hot side conductor 6, i.e., a direction contrary to the flow within the hot side conductor. When disposed in such a manner, the exhaust 14 allows the bypass flow to empty into the hot side conductor 6 through the openings 16 in a direction opposite that of the flow from the heat exchangers 8, causing the two flows to sufficiently mix without an active mixer. In one embodiment, the exhaust 14 is an inverted J-shaped exhaust having openings 16 disposed on the upper half of the hot side conductor 6, i.e., above the line 44 dividing upper half and lower half of the hot side conductor 6. As colder water is denser, it tends to drop when exiting the exhaust of the bypass conductor 10, again causing the cold bypass flow to mix favorably and naturally with the hot water of the heat exchangers 8. In another embodiment, the exhaust 14 further includes an opening allowing effluents from the opening to be pointed in a direction perpendicular to the direction from the exit end of the hot side conductor 6 to the closed end of the hot side conductor 6.

Figure 3:
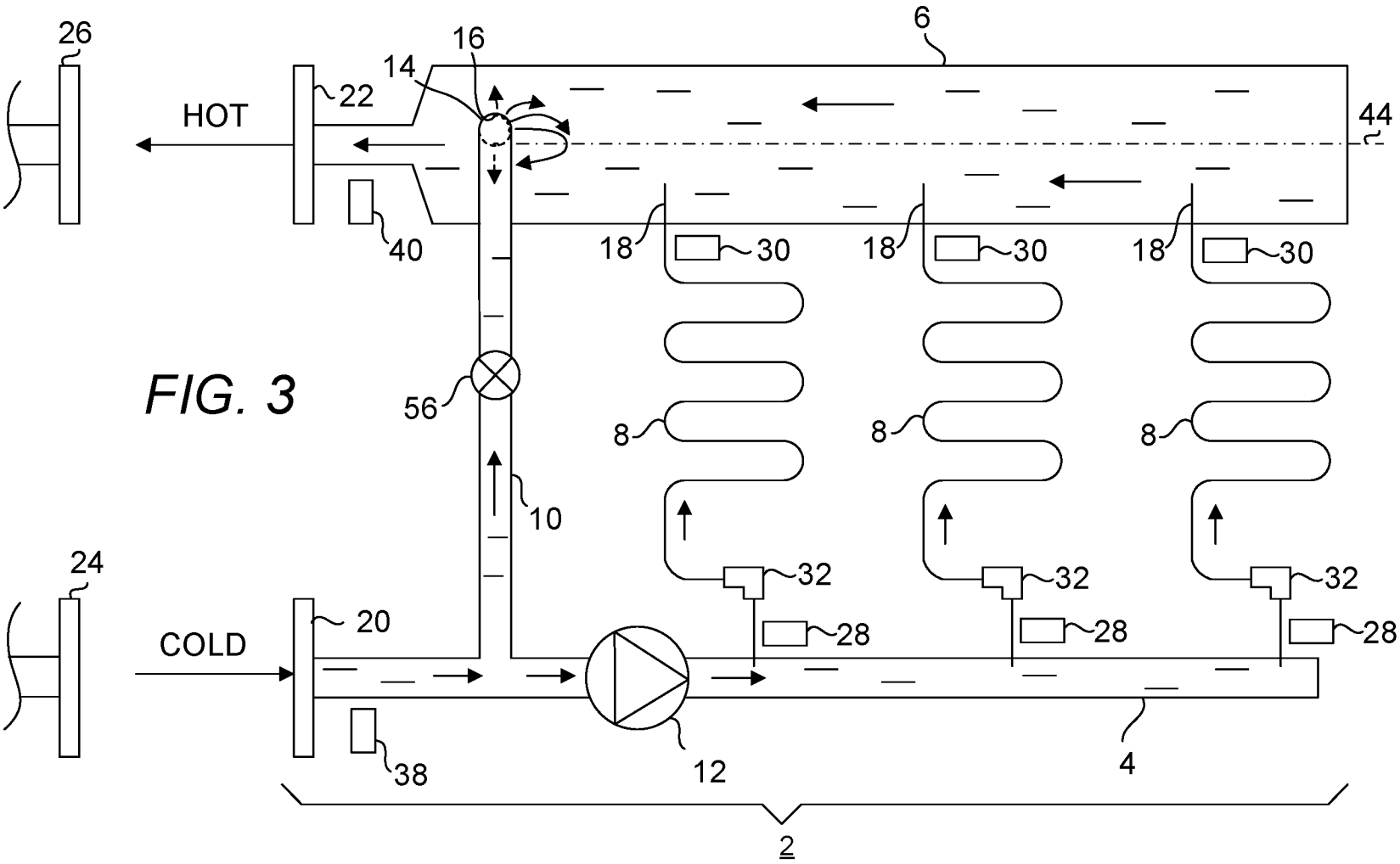
FIG. 3 is a diagram depicting one embodiment of a low pressure drop water heating system where one or more heat exchangers are used and a forward flow is observed in the bypass conductor.
Figure 4:
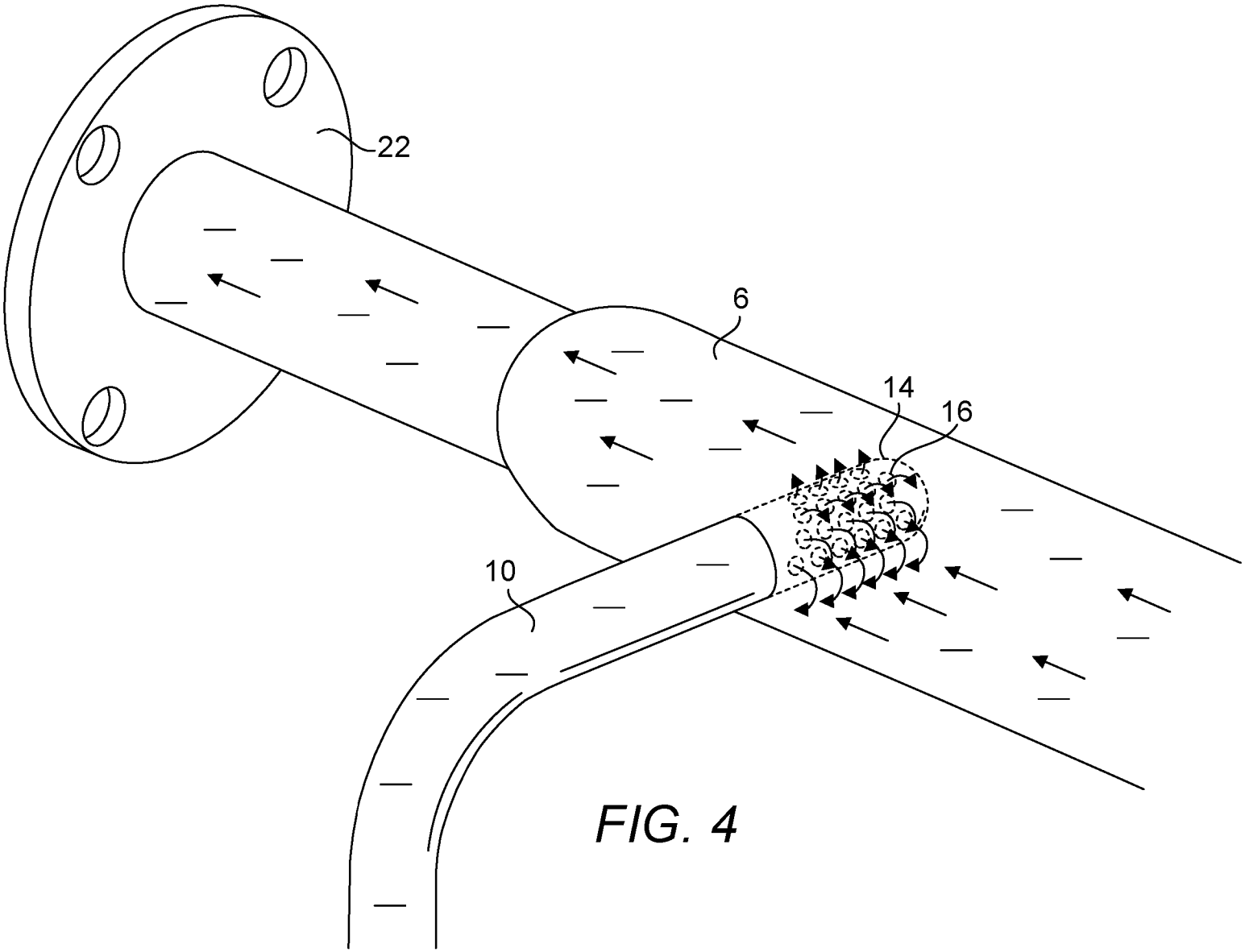
FIG. 4 is a partial transparent view of one embodiment of an exhaust of a bypass conductor of a low pressure drop water heating system.

FIG. 3 is a diagram depicting one embodiment of a low pressure drop water heating system where one or more heat exchangers are used and a forward flow is observed in the bypass conductor. In this embodiment, a valve 56 is further provided to control flow through the bypass conductor 10. This valve 56 is normally disposed in the open state, except when two conditions have been encountered. First, if system outlet temperature sensor 40 has been determined to have ceased functioning, e.g., as inferred from a sudden loss of input signals from this sensor, valve 56 is closed to prevent any flow through it. In producing hot water, unheated water is simply received at 20, sent through the cold side conductor 4 before entering the heat exchangers 8 to be heated. Heated water empties into the hot side conductor 6 and proceeds to exit via the hot side conductor 22. Second, if the pump 12 has been determined to have ceased to function, e.g., as inferred from a lower than expected flowrate detected at any one of the flow valves 32, valve 56 is also closed to prevent any flow through it. A failed pump 12 does not prevent a flow that is caused by a hot water demand at one or more points of use. If a pump has been determined to have failed, hot water demand is serviced in the same manner as in the case where the system outlet temperature sensor 40 has failed. A failure can be logged for purposes of problem diagnosis at a later time. It may also be communicated to a service personnel in real time or at a later time. As shown herein, each heat exchanger 8 is equipped with an inlet temperature sensor 28 and an outlet temperature sensor 30. If any one of the inlet temperature sensors fails, at least one of the remaining functional inlet temperature sensors is relied upon until the condition is corrected. If any one of the outlet temperature sensors fails, at least one of the remaining functional outlet temperature sensors is relied upon until the condition is corrected. These limp along modes prevent the need for a complete shutdown of the water heating system such that the water heating system can continue to service points of use until corrective actions can be taken. FIG. 3 also depicts another embodiment of a bypass conductor exhaust 14. In this embodiment, the exhaust is not J-shaped. Instead the exhaust is a straight tube inserted into the hot side conductor 6 through a side wall. FIG. 4 is a partial transparent view of one embodiment of an exhaust of a bypass conductor 10 of a low pressure drop water heating system. In this embodiment, the exhaust 14 includes more effective openings 16 which allow effluents from the openings to be pointed in a direction from the exit end 22 of the hot side conductor 6 to the closed end of the hot side conductor 6 than openings which allow effluents from the openings to be pointed in a direction from the closed end of the hot side conductor 6 to the exit end 22 of the hot side conductor 6. When disposed in such a manner, the exhaust 14 allows the bypass flow to empty into the hot side conductor 6 through the openings 16 in a direction opposite that of the flow from the heat exchangers 8, causing the two flows to sufficiently mix without an active mixer.

Figure 5:
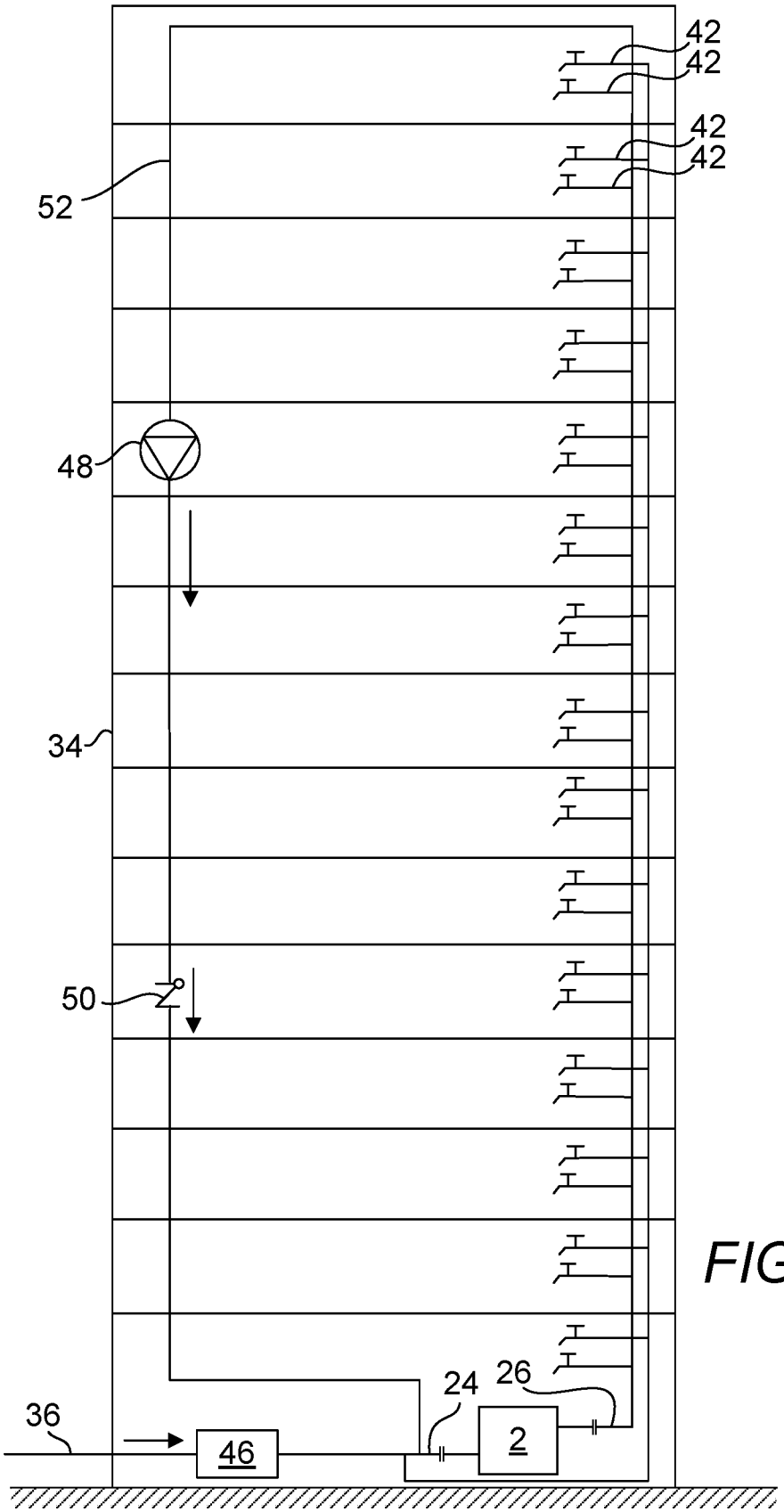
FIG. 5 is a diagram depicting the use of a low pressure drop water heating system to deliver hot water to a high rise building which has traditionally been serviced using a tank water heating system.
Figure 6:
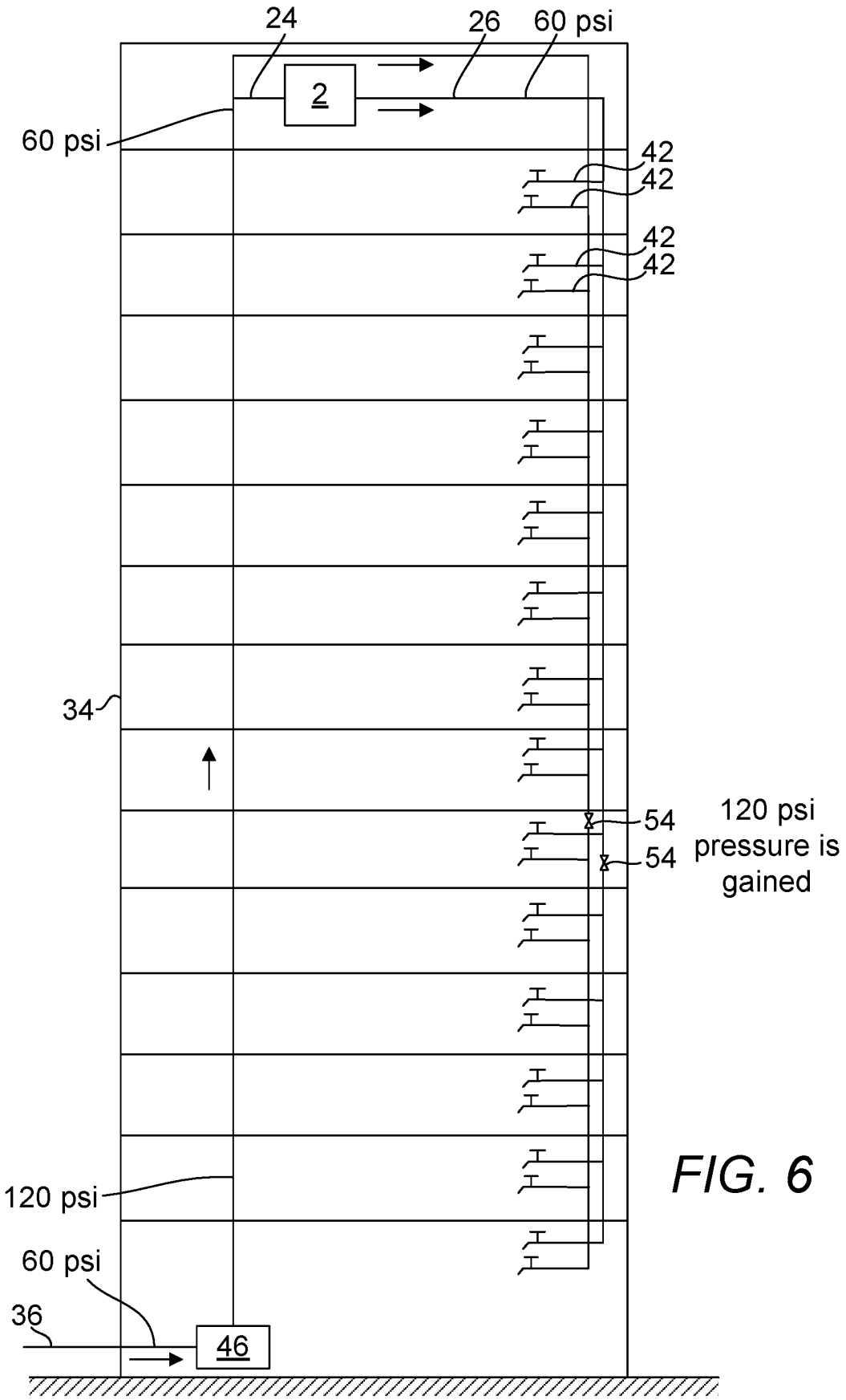
FIG. 6 is another diagram depicting the use of a low pressure drop water heating system to deliver hot water to a high rise building which has traditionally been serviced using a tank water heating system.

FIG. 5 is a diagram depicting the use of a low pressure drop water heating system 2 to deliver hot water to a high rise building 34 which has traditionally been serviced using a tank water heating system. Such an application typically involves the aid of a pressure booster pump 46 to deliver both hot and cold water to customers due to insufficient water pressure with simply municipal water supply. The present water heating system is capable of receiving a cold water supply 36, preparing the water to a desired temperature and delivering the prepared water to points of use 42 of a high rise building 34 at multiple floors. FIG. 6 is another diagram depicting the use of a low pressure drop water heating system 2 to deliver hot water to a high rise building which has traditionally been serviced using a tank water heating system. It shall be noted that the water heating system 2 is mounted at the top of the building 34 instead of the bottom of the building 34. FIG. 6 is another diagram depicting the use of a low pressure drop water heating system to deliver hot water to a high rise building which has traditionally been serviced using a tank water heating system.

Figure 7:
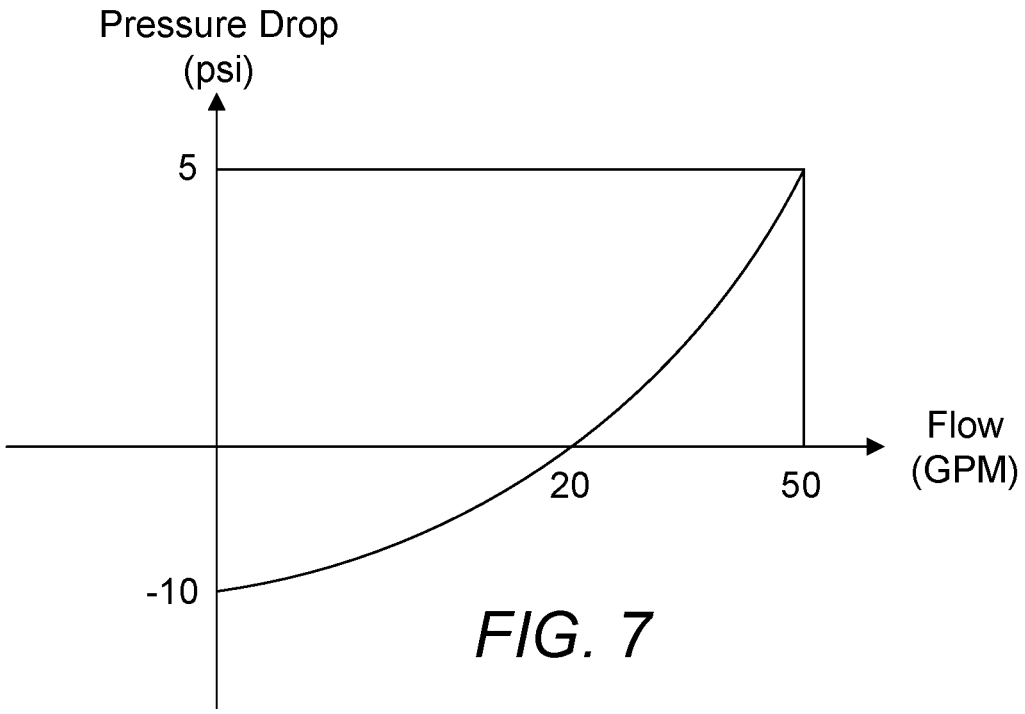
FIG. 7 is a graph depicting an example pressure drop curve in a water heating system using a present water heating system without effecting flow valve control.
Figure 8:
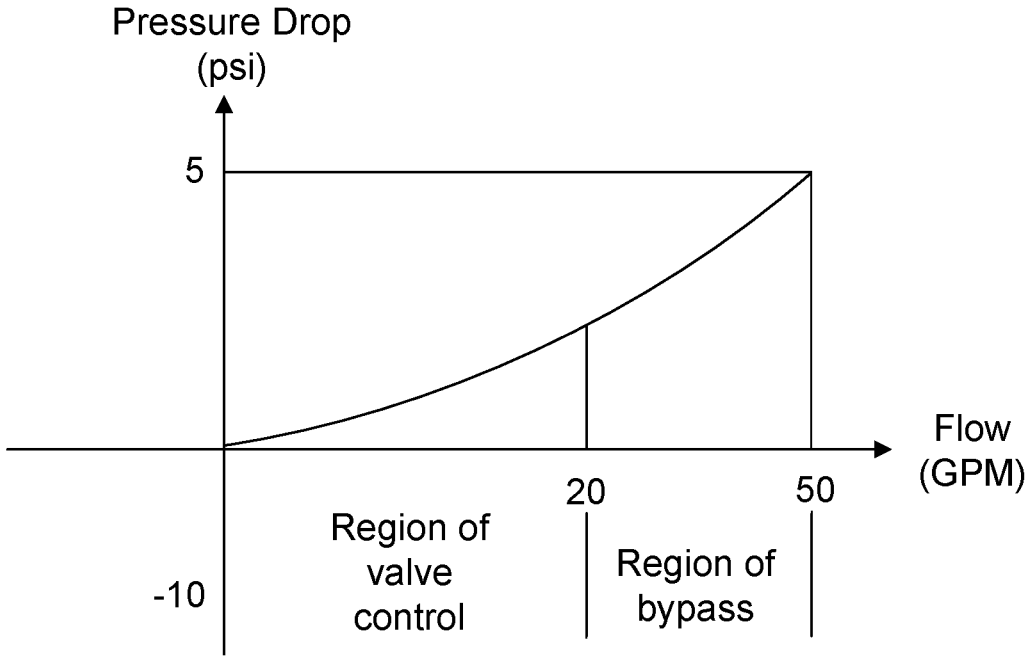
FIG. 8 is a graph depicting an example pressure drop curve of a low pressure drop water heating system.

FIG. 7 is a graph depicting an example pressure drop curve in a water heating system using a present water heating system without effecting flow valve 32 control. It shall be noted that without flow valve 32 control, during certain low flowrates of up to, e.g., 20 Gallons Per Minute (GPM), there is a pressure gain. FIG. 8 is a graph depicting an example pressure drop curve of a low pressure drop water heating system. It shall be noted that the graph represents a pressure drop-flowrate plot that mimics a tank water heating system, i.e., with suitable pressure drop at larger flowrates.

Figure 9:
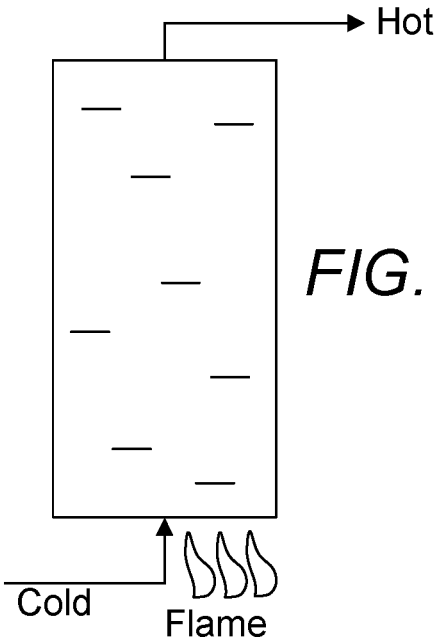
FIG. 9 is a diagram depicting the representation of a conventional or tank water heating system with cold water being received in a large tank and this large volume of water being heated in the large tank.
Figure 10:
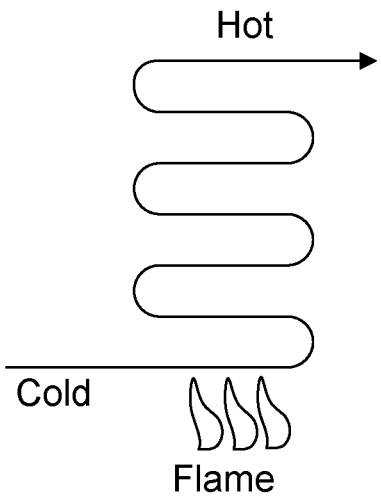
FIG. 10 is a diagram depicting the representation of a heat exchanger element of a present water heating system where hot water is produced as a demand exists and therefore a large tank is not required or desired.
Figure 11:
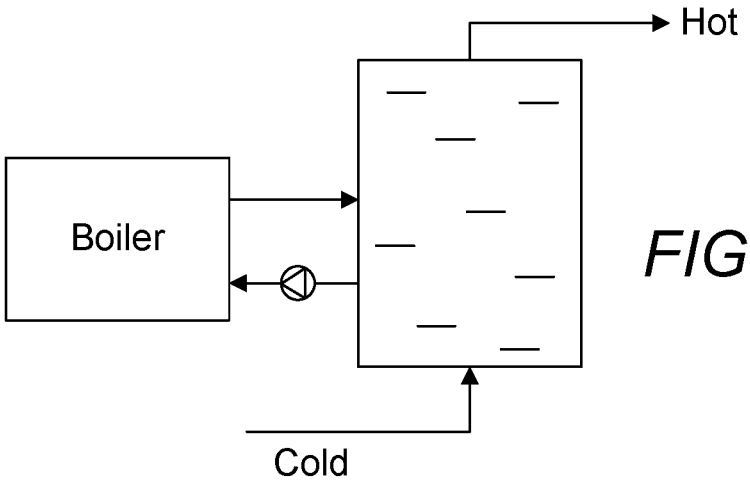
FIG. 11 depicts a typical water heating system with a storage tank and a boiler.

FIG. 9 is a diagram depicting the representation of a conventional or tank water heating system with cold water being received in a large tank and this large volume of water being heated in the large tank. In contrast, FIG. 10 is a diagram depicting the representation of a heat exchanger element of a present water heating system where hot water is produced as a demand exists and therefore a large tank is not required or desired. FIG. 11 is a typical water heating system with a storage tank and a boiler. Note again the use of a large tank as compared to a present water heating system.

Figure 12:
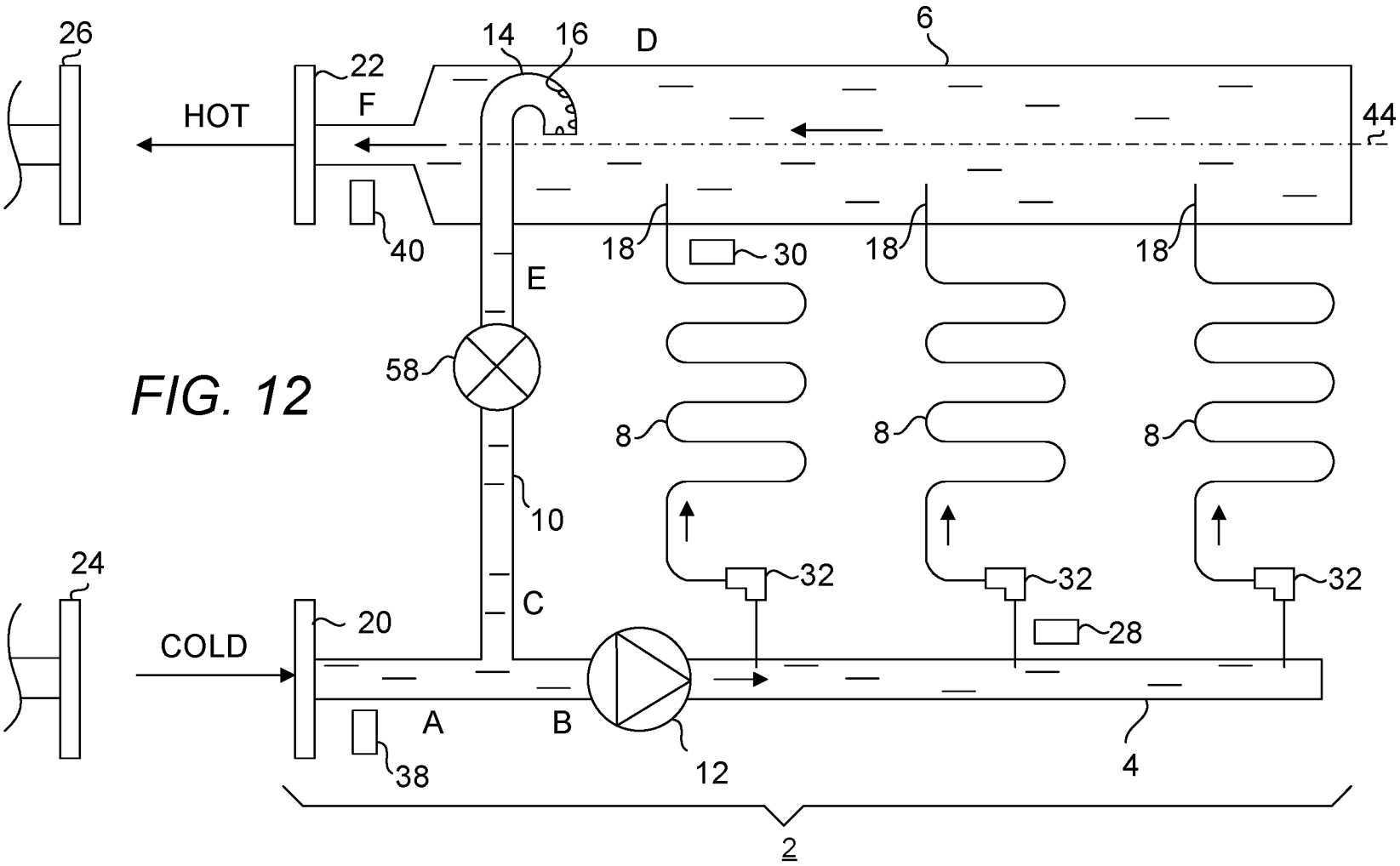
FIG. 12 is a diagram depicting an embodiment of a zero pressure drop water heating system including a bypass conductor.
Figure 13:
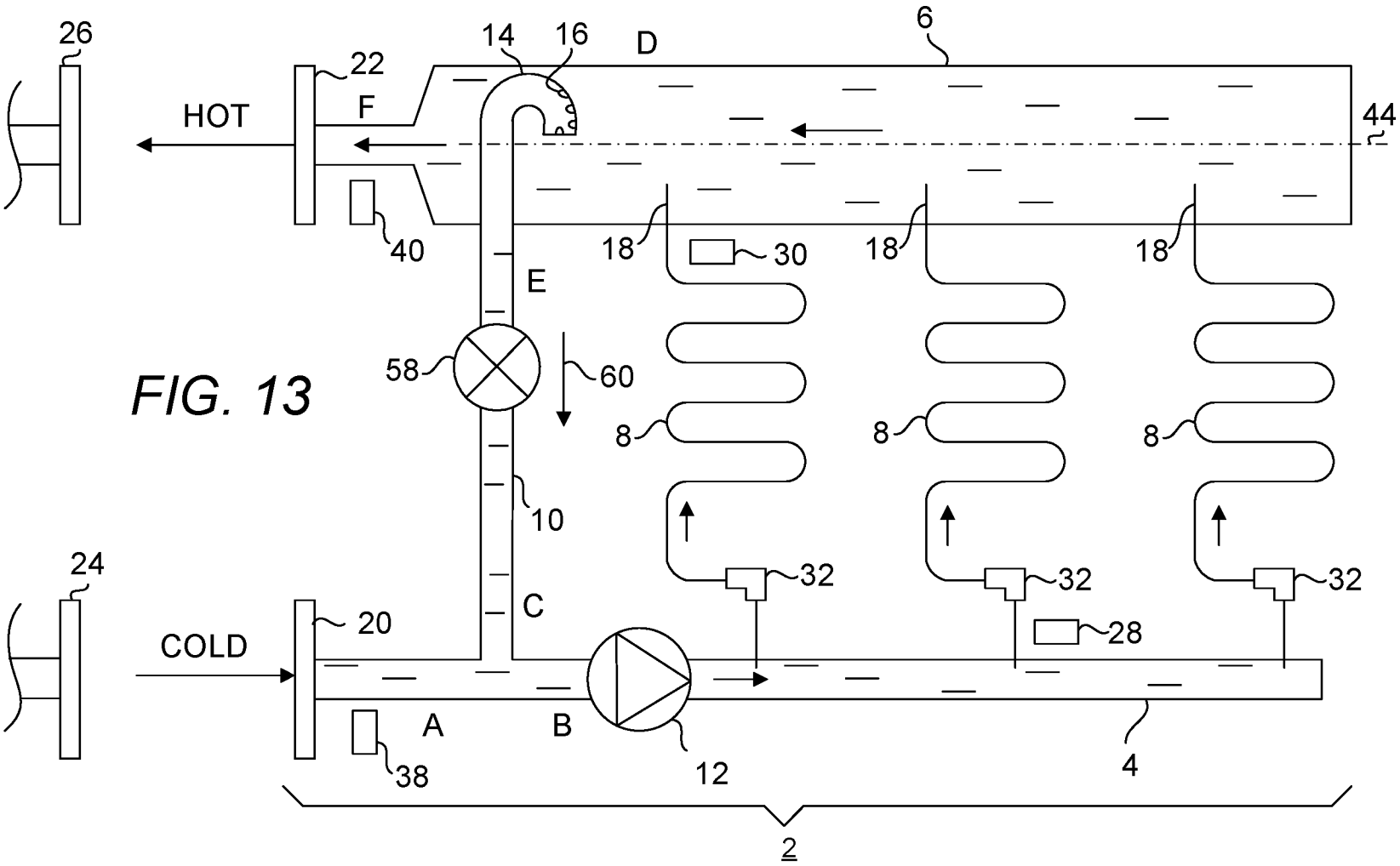
FIG. 13 is a diagram depicting the embodiment of FIG. 12 with a recirculating flow in the bypass conductor.

The term "zero pressure drop" as used herein shall be defined as the net pressure drop as experienced by an output flow that is zero at the system outlet 22 while the desired temperature at the system outlet 22 is maintained. It shall be apparent, upon reviewing the ensuing figures and their description that a zero pressure drop can be achieved at the system outlet of a present water heating system. FIG. 12 is a diagram depicting an embodiment of a zero pressure drop water heating system including a bypass conductor. FIG. 13 is a diagram depicting the embodiment of FIG. 12 with a recirculating flow in the bypass conductor 10. The water heating system shown in FIG. 12 is similar to the water heating system shown in FIG. 1 with the exception that the water heating system of FIG. 12 includes a bypass valve 58 disposed on the bypass conductor 10. The bypass valve 58 can be a motorized valve that is an on-off valve or a modulating valve, etc. It shall be noted that for the disclosures related to FIGS. 12-14, the fluid conductors are not limited to those disclosed in FIGS. 12-13. The fluid conductors may be of similar if not identical sizes and the exhaust 14 is not limited to the various types shown elsewhere herein. In one embodiment not shown, the exhaust 14 is omitted altogether although each exhaust shown herein promotes mixing and makes the output temperature more even. In one embodiment, the bypass valve 58 can be a thermostatic valve where a temperature differential between the inlet and outlet ports of the thermostatic valve causes the thermostatic valve to control the flow through it from one of its ports to the other one of its ports. For instance, if excessively high temperature is experienced in the flow at location D (see FIG. 12 or 13), then bypass valve 58 will allow mixing of unheated water through the bypass conductor 10 to temper the excessively hot flow at location D to result in a flow disposed at desired temperature at the system output 22.

Figures 14, 15:
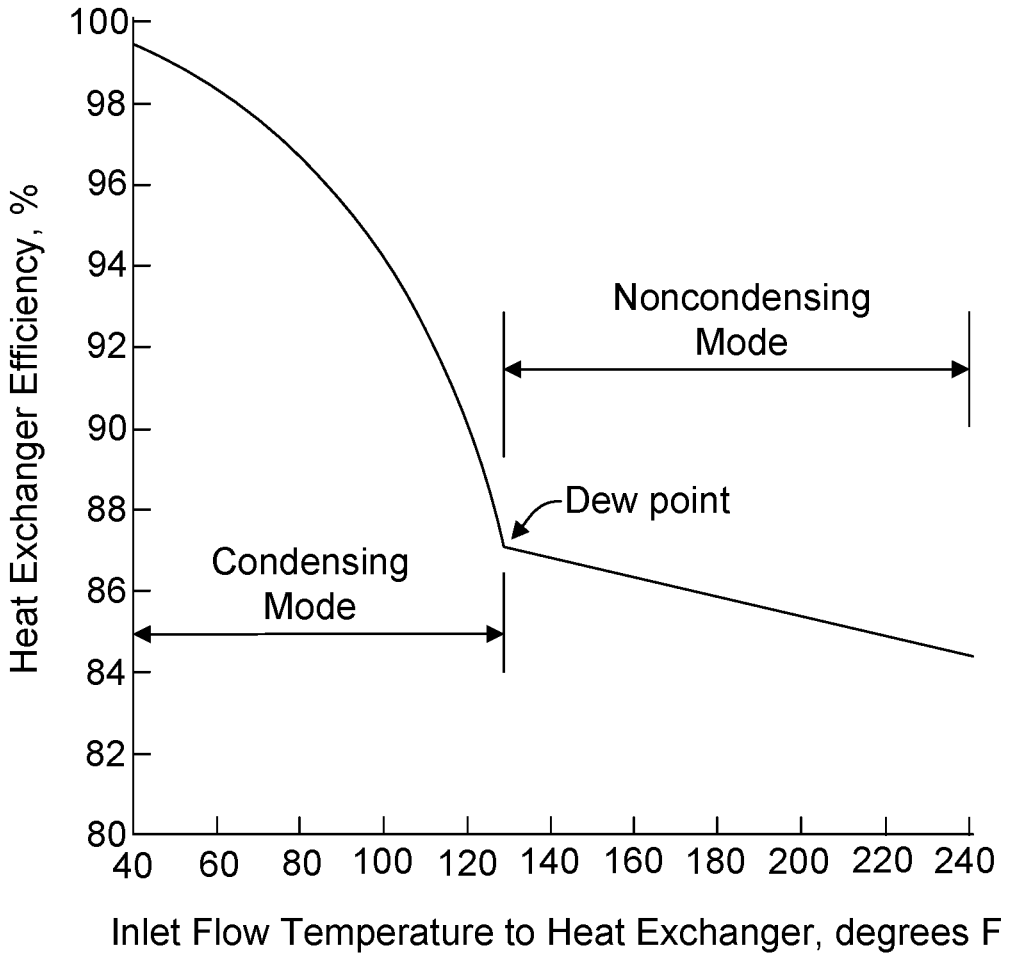
FIG. 14 is a table showing flowrates through various portions of the water heating system shown in FIGS. 12-13.
FIG. 15 is a diagram depicting the efficiency of a heat exchanger in FIG. 12 with respect to the temperature of the inlet flow to the heat exchanger.

For sake of clarity, FIG. 14 is provided to show flowrates through various locations of a system according to FIGS. 12-13. There are four rows of data representing four different flow scenarios, i.e., at demands of 0, 1, 5 and 6 GPM. The pump 12 operates at 5 GPM in any one of these scenarios. As indicated by the first scenario, without a demand, no new flow is drawn through the system inlet 20. All of the 5 GPM of flow pushed by the pump 12 recirculates, causing a 5 GPM through location B, C, D or E. Notice that there is not a flow through location A or F. Once a 1 GPM demand exists, the demand is met by a 1 GPM flow through the system outlet 22 and a 1 GPM flow is drawn through location A to replenish it. The pump 12 pulls 5 GPM of flow through location B. The 1 GPM from the system inlet 20 and the recirculation flow of 4 GPM through location C combine to make up the total flow of 5 GPM through the pump 12. A flow of 5 GPM through location D is split into 4 GPM of recirculation flow through location E and 1 GPM of heated flow through location F to service the demand of 1 GPM. At a demand of 5 GPM, 5 GPM is drawn through the system inlet 20 through location A. This demand matches the pump size and the pump 12 pulls the entire incoming flow and pushes it through at least one of the heat exchangers 8 to supply through location D or F a heated flow of 5 GPM. No recirculation through location E occurs in this case as the demand matches the pump size. The pump 12 is said to be oversized in the 0 and 1 GPM demand scenarios as the pump 12 is sized for a flow higher than the demand. In the last scenario of the table, a 6 GPM flow demand exists and causes 6 GPM of flow to be drawn through location A. The pump 12 still pushes a 5 GPM flow through location B as it is sized at 5 GPM and therefore a bypass flow of 1 GPM occurs through location C. Note that a bypass flow is indicated by a negative sign preceding the flow magnitude. A flow of 5 GPM through location D and a bypass flow of 1 GPM through location E merge to form a flow of 6 GPM through location F. The pump 12 is said to be undersized in the 6 GPM demand scenario as the pump 12 is sized for a flow lower than the demand.

If pump 12 is oversized, the pressure rise caused by the pump 12 will be too large in the system if the demand at the system outlet is small. This oversize condition is chronic if the level of demand never achieves what the pump is sized to deliver. For example, if the pump is a 10 GPM pump and the maximum demand is only 8 GPM, there will always be at least 2 GPM of recirculation flow that needs to be recirculated via the bypass conductor 10. A chronic oversize condition can occur if an oversized replacement pump has been used or the demand has permanently dropped. The oversize condition is temporary if the demand drops due to non-use at certain times of a day but normally the pump is otherwise required to meet a flow demand at the pump size during other times of the day. At least one of three devices may be used to alleviate this condition. If the pump is a variable speed pump, its speed may be decreased to alleviate the pressure rise. Additionally, or alternatively, the bypass valve 58 and/or the flow valve 32 may be modulated to alleviate the pressure rise and the firing rate of at least one heat exhangers 8 may be adjusted such that a desired temperature at the system outlet can be achieved. The flow valve 32 can be a motorized valve that is a modulating valve. At least one of the flow valves 32 may be adjusted to temper the pressure rise. The bypass valve 58 may be adjusted to control the recirculation flowrate through the bypass conductor 10 which ultimately determines the inlet temperature to a heat exchanger 8. Left unattended, a pressure rise can be experienced at a point of use downstream from the system outlet 22 in addition to a possible increase in the recirculation flow through the bypass conductor 10 which increases the inlet temperature to a heat exchanger 8, a condition that may lower the heat exchanger efficiency as will be apparent elsewhere herein.

However, if pump 12 is undersized, then there will be a significant pressure drop caused by the undersized pump during high flow as the pump is unable to meet the demand. This undersize condition is chronic if the level of demand always exceeds what the pump is sized to deliver. Again, for example, if the pump 12 is a 10 GPM pump and the maximum demand exceeds 12 GPM, there will always be at least 2 GPM of bypass flow that needs to be recirculated via the bypass conductor 10. A chronic undersize condition can occur if an undersized replacement pump has been used or the demand has permanently increased. The undersize condition is temporary if the increased demand only occurs during certain times of a day but normally the pump is otherwise sized sufficiently to meet a flow demand during other times of the day. If the pump is a variable speed pump and the demand can still be met at the maximum speed of the pump, the pump speed may be increased to compensate for the pressure drop. When a demand cannot be met by the pump again, again, additionally or alternatively, the bypass valve 58 and/or the flow valve 32 may be modulated to alleviate the pressure drop. The bypass valve 58 may be enlarged to allow a higher bypass flowrate through it to make up for the demand gap left by the pump 12. The setpoint of a heat exchanger 8 will need to be increased so that the effluent of the heat exchanger 8 will be hotter such that when it is merged with the bypass flow at a higher flowrate, the system outlet 22 temperature is disposed at a desired temperature. Care must be taken such that the bypass flow through the bypass conductor 10 may not be so abundant that the flow that continues on to the pump is starved to a point that local boiling or boiling develops in a heat exchanger 8. The flow valve 32 of a heat exchanger 8 may be adjusted to permit a inlet flow of a higher or lower flowrate through the heat exchanger 8 to provide more hot fluid flow of a first temperature at the outlet of the heat exchanger 8 or less hot fluid flow of a second temperature at the outlet of the heat exchanger 8 where the second temperature is greater than the first temperature.

Further when the bypass valve 58 is open and the pump 12 is running and during periods when demand is lower than the recirculation flow through the bypass conductor 10, the temperature of the inlet flow to one or more of the heat exchangers 8 would be higher than cold inlet flow to the heating system 2 as there will be an increased flowrate of the heated flow being recirculated as shown in FIG. 13 as flow 60 increases the temperature of the combined flow of the system inlet and this recirculating flow. This reduces the efficiency of the affected heat exchangers 8. FIG. 15 is a diagram depicting the efficiency of a heat exchanger in FIGS. 12-13 with respect to the temperature of the inlet flow to the heat exchanger. It shall be noted from FIG. 15 that as the inlet flow temperature increases, the heat exchanger efficiency decreases. For instance, at an inlet flow temperature of 60 degrees, the heat exchanger efficiency is at over about 98%. However, at an inlet flow temperature of 100 degrees F., the heat exchanger efficiency drops to about 94%. Therefore, for the sake of efficiency of the heat exchangers, the inlet flow temperature to a heat exchanger should be kept as close to the unheated system inlet temperature as possible. The bypass valve 58 may be throttled to control the flowrate of recirculation flow through bypass valve 58 to ensure that the representative temperature to the heat exchangers 8, as indicated by inlet temperature sensor 28, is now indicative of the heat exchangers 8 operating in high efficiency. In other words, the bypass valve 58 is controlled in a manner such that the inlet temperature as reported by inlet temperature sensor 28 is as close to the system inlet temperature as reported by the system inlet temperature sensor 38.

Further, If the pump 12 fails, the entire flow received at the system inlet will flow through the bypass conductor 10 due to the lower pressure drop of the bypass conductor 10 and no flow will occur through the heat exchangers, thereby preventing any hot fluid from getting delivered at the system outlet. A pump failure is determined to have occurred if no flow is registered by any one of a plurality of flow sensors each configured to sense a flow through a heat exchanger 8 although when each flow valve 32 is at least partially open. A failed pump presents a large pressure drop across it, forcing the entire system inlet flow to traverse the bypass valve 58 instead of the pump 12. Left unattended, a failed pump will cause the cold system inlet flow to bypass the heat exchangers 8 and the same cold system inlet flow will be delivered at the system outlet. Therefore, in order to mitigate the problems brought on by a pump failure, the bypass valve 58 is closed partially or entirely to force the entire system inlet flow through the failed pump 12 such that the system inlet flow can be distributed in the heat exchangers 8 to be heated to ensure uninterrupted delivery of a heated flow.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A zero pressure drop water heating system comprising: (a) a cold side conductor comprising a receiving end and a closed end; (b) a hot side conductor comprising an exit ends and a closed end and an interior surface; (c) a pump; (d) a bypass conductor comprising a first end, a second end and a bypass valve disposed between said first end and said second end of said bypass conductor and an exhaust disposed through and past said interior surface towards the center of the hot side conductor, said exhaust comprising at least one opening configured for allowing effluents of said at least one opening to be emptied into said hot side conductor at a location away from said interior surface of said hot side conductor, wherein said first end of said bypass conductor is adapted to said receiving end of said cold side conductor and said second end of said bypass conductor is adapted to said exit end of said hot side conductor; (e) at least one heat exchanger comprising a flow valve; (f) an inlet temperature sensor disposed on an inlet of said at least one heat exchanger; (g) an outlet temperature sensor disposed on an outlet of said at least one heat exchanger closest to said exit end of said hot side conductor; (h) a system outlet temperature sensor disposed on said exit end of said hot side conductor; and (i) a system inlet temperature sensor disposed on said receiving end of said cold side conductor, wherein said receiving end of said cold side conductor is configured to be connected to a cold water supply manifold, said exit end of said hot side conductor is configured to be connected to a hot water supply manifold, said pump is configured to generate a flow through each of said at least one heat exchanger and whereby when a temperature indicated by said inlet temperature sensor exceeds a temperature indicated by said system inlet temperature sensor, said flow valve of said at least one heat exchanger is configured to be restricted to enable an increased flow from said receiving end of said cold side conductor to said exit end of said hot side conductor through said bypass conductor to temper a flow exiting said exit end of said hot side conductor, said at least one opening of said exhaust causes said effluents of said at least one opening to be mixed with the flow, when a temperature indicated by said system outlet temperature sensor falls below a temperature indicated by said inlet temperature sensor, said flow valve of said at least one heat exchanger is configured to be enlarged to enable an increased flow from said cold side conductor to said exit end of said hot side conductor through said at least one heat exchanger to increase the temperature of the flow exiting said exit end of said hot side conductor and at least one of said bypass valve, said flow valve and said pump is used for controlling flow through said zero pressure drop water heating system to result in a pressure drop of zero at said exit end of said hot side conductor.

2. The zero pressure drop water heating system of claim 1, wherein said at least one opening is configured to be pointed in a direction from said exit end of said hot side conductor to said closed end of said hot side conductor.

3. The zero pressure drop water heating system of claim 1, wherein said exhaust is configured to be disposed on said second end of said bypass conductor and said hot side conductor further comprises an upper half and a lower half and said exhaust is configured to be disposed on said upper half of said hot side conductor.

4. The zero pressure drop water heating system of claim 1, wherein said exhaust is configured to be disposed on said second end of said bypass conductor and said hot side conductor further comprises an upper half and a lower half and said exhaust is an inverted J-shaped exhaust and said at least one opening is configured to be disposed on said upper half of said hot side conductor.

5. The zero pressure drop water heating system of claim 1, wherein said exhaust is configured to be disposed on said second end of said bypass conductor, said at least one opening is configured for allowing effluents of said at least one opening to be pointed in a direction perpendicular to a direction from said exit end of said hot side conductor to said closed end of said hot side conductor.

6. The zero pressure drop water heating system of claim 1, wherein said hot side conductor further comprises a volume of from about 0.5 to about 2 gallons and said bypass conductor comprises a tubing of size of from about 0.5 to about 1.5 inches.

7. The zero pressure drop water heating system of claim 1, wherein said bypass valve is a motorized valve.

8. The zero pressure drop water heating system of claim 1, wherein said bypass valve is a device selected from the group consisting of an on-off valve and a modulating valve.

9. The zero pressure drop water heating system of claim 1, wherein said bypass valve is a thermostatic valve.

10. The zero pressure drop water heating system of claim 1, wherein said flow valve is a modulating valve.

* * * * *